US009650121B2

(12) United States Patent
Kinoshita et al.

(10) Patent No.: US 9,650,121 B2
(45) Date of Patent: May 16, 2017

(54) WATERCRAFT

(71) Applicant: YAMAHA HATSUDOKI KABUSHIKI KAISHA, Iwata-shi, Shizuoka (JP)

(72) Inventors: Yoshimasa Kinoshita, Shizuoka (JP); Yukitaka Okamoto, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 249 days.

(21) Appl. No.: 14/484,542

(22) Filed: Sep. 12, 2014

(65) Prior Publication Data

US 2015/0093946 A1 Apr. 2, 2015

(30) Foreign Application Priority Data

Oct. 2, 2013 (JP) ..... 2013-207375

(51) Int. Cl.

| | |
|---|---|
| ***B63H 5/07*** | (2006.01) |
| ***B63H 23/30*** | (2006.01) |
| ***B63H 21/21*** | (2006.01) |
| *B63H 11/02* | (2006.01) |
| *B63H 23/08* | (2006.01) |

(52) U.S. Cl.

CPC ..... *B63H 23/30* (2013.01); *B63H 21/21* (2013.01); *B63H 5/07* (2013.01); *B63H 11/02* (2013.01); *B63H 23/08* (2013.01)

(58) Field of Classification Search

CPC ..... Y02T 10/48

See application file for complete search history.

(56) References Cited

U.S. PATENT DOCUMENTS

| | | | | |
|---|---|---|---|---|
| 8,494,711 | B2 * | 7/2013 | Tiwari | B60W 50/0225 123/179.1 |
| 2001/0018903 | A1 | 9/2001 | Hirose et al. | |
| 2003/0150417 | A1 * | 8/2003 | Miwa | F02N 11/0833 123/179.4 |
| 2006/0172626 | A1 * | 8/2006 | Longdill | B60F 3/0007 440/12.5 |
| 2006/0219146 | A1 * | 10/2006 | Gibbs | B60F 3/0007 114/144 R |
| 2011/0246046 | A1 * | 10/2011 | Ichinose | F02D 17/04 701/103 |

FOREIGN PATENT DOCUMENTS

JP 2001-248469 A 9/2001

* cited by examiner

*Primary Examiner* — Edwin Swinehart

(74) *Attorney, Agent, or Firm* — Keating and Bennett, LLP

(57) ABSTRACT

A watercraft includes a vessel body, a propulsion mechanism, an engine, a shift operating unit, a vessel body state determining unit, and an engine controlling unit. The propulsion mechanism is switched among a forward thrust state to forwardly move the vessel body, a rearward thrust state to rearwardly move the vessel body, and a neutral state to maintain the vessel body in a stationary state. The shift operating unit is configured to move to a forward thrust position, a rearward thrust position, and a neutral position. The vessel body state determining unit is programmed and configured to determine whether or not the vessel body is in the stationary state. The engine controlling unit is programmed and configured to stop the engine when the shift operating unit is located in the neutral position and the vessel body state determining unit determines that the vessel body is in the stationary state.

13 Claims, 9 Drawing Sheets

WATERCRAFT

CROSS-REFERENCE TO RELATED APPLICATIONS

This application claims priority under 35 U.S.C. §119 to Japanese Patent Application No. 2013-207375, filed on Oct. 2, 2013. The entire disclosure of Japanese Patent Application No. 2013-207375 is hereby incorporated herein by reference.

BACKGROUND OF THE INVENTION

1. Field of the Invention

The present invention relates to a watercraft equipped with an engine.

2. Description of the Related Art

An idling stop function has been widely used on vehicles designed to move on the ground. The idling stop function is a function to stop an engine when a condition is satisfied that a brake pedal is pressed down to temporarily stop movement of a vehicle (see e.g., Japan Laid-open Patent Application Publication No. JP-A-2001-248469).

By contrast, a watercraft is not equipped with a brake pedal. Hence, to apply the idling stop function to an engine of the watercraft, it is required to appropriately set a condition to perform the idling stop function. However, because of the non-existence of the brake pedal, it is not easy to accurately determine that a vessel operator is intending to not operate the watercraft.

SUMMARY OF THE INVENTION

Preferred embodiments of the present invention have been conceived in view of the above described situation, and provide a watercraft in which the intention to operate the watercraft is reflected in the idling stop function.

A watercraft according to a preferred embodiment of the present invention includes a vessel body, a propulsion mechanism, an engine, a shift operating unit, a vessel body state determining unit, and an engine controlling unit. The propulsion mechanism is configured to switch among a forward thrust state to forwardly move the vessel body, a rearward thrust state to rearwardly move the vessel body, and a neutral state to maintain the vessel body in a stationary, or unmoved, state. The engine is configured to drive the propulsion mechanism. The shift operating unit is configured to move to a forward thrust position to switch the propulsion mechanism into the forward thrust state, a rearward thrust position to switch the propulsion mechanism into the rearward thrust state, and a neutral position to switch the propulsion mechanism into the neutral state. The vessel body state determining unit is programmed and configured to determine whether or not the vessel body is in the stationary state. The engine controlling unit is programmed and configured to stop the engine when the shift operating unit is located in the neutral position and the vessel body state determining unit determines that the vessel body is in the stationary state.

According to the preferred embodiments of the watercraft disclosed herein, it is possible to provide a watercraft in which the intention to operate the watercraft is reflected in an idling stop function.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
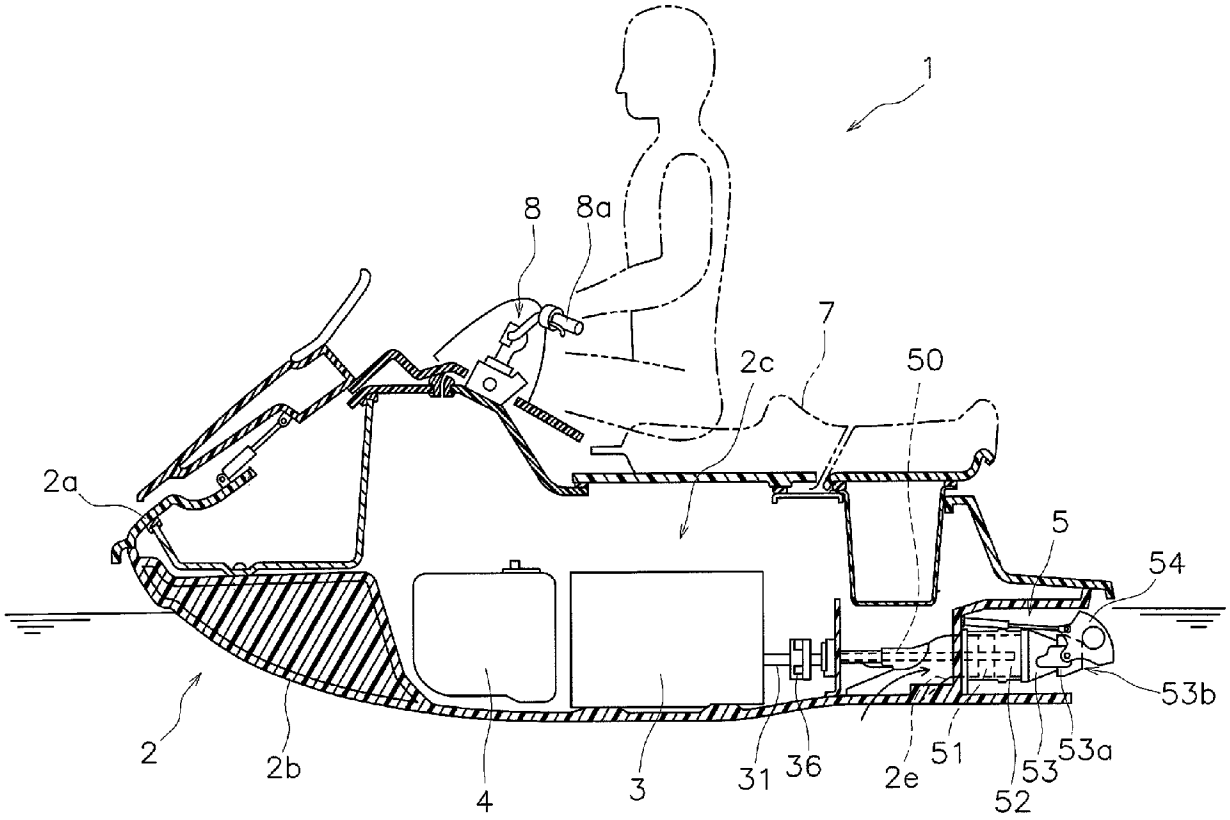
FIG. 1 is a cross-sectional view of a schematic structure of a jet propelled watercraft according to a first preferred embodiment of the present invention.

With reference to the drawings, explanation will be hereinafter made for a jet propelled watercraft as an example of a watercraft. FIG. 1 is a cross-sectional view of a schematic structure of a jet propelled watercraft 1 according to a first preferred embodiment. The jet propelled watercraft 1 is so-called a personal watercraft (PWC). The jet propelled watercraft 1 includes a vessel body 2, an engine 3, and a propulsion mechanism 5. The vessel body 2 includes a deck 2*a* and a hull 2*b*. An engine compartment 2*c* is provided inside the vessel body 2. The engine compartment 2*c* accommodates the engine 3, a fuel tank 4 and so forth. The engine 3 includes a crankshaft 31. The crankshaft 31 is disposed so as to extend in the back-and-forth direction. A seat 7 is attached to the deck 2*a*. The seat 7 is disposed above the engine 3. A steering handle 8 is disposed forward of the seat 7 in order to regulate the moving direction of the vessel body 2. A pair of handles 8*a* is mounted to ends of the steering handle 8. A vessel operator operates the jet propelled watercraft 1 while holding the pair of handles 8*a* with both hands.

The propulsion mechanism 5 is configured to generate thrust to propel the vessel body 2 by a driving force from the engine 3. The propulsion mechanism 5 is configured to suck in and eject water that surrounds the vessel body 2. The propulsion mechanism 5 is switchable among a forward thrust state to move the vessel body 2 forward, a rearward thrust state to move the vessel body 2 rearward, and a neutral state to maintain a stationary state of the vessel body 2. The propulsion mechanism 5 includes an impeller shaft 50, an impeller 51, an impeller housing 52, a nozzle 53, and a bucket 54. A jet propulsion device, configured to generate a jet of water to be ejected rearward, includes the impeller shaft 50, the impeller 51, the impeller housing 52, and the nozzle 53.

The impeller shaft 50 is disposed so as to extend rearward from the engine compartment 2*c*. The front portion of the impeller shaft 50 is coupled to the crankshaft 31 through a coupling unit 36. The rear portion of the impeller shaft 50 extends into the impeller housing 52 through a water suction unit 2*e* of the vessel body 2. The impeller housing 52 is connected to the rear portion of the water suction unit 2*e*.

The nozzle 53 is disposed rearward of the impeller housing 52. The nozzle 53 is provided with a steering nozzle 53*a*. The steering nozzle 53*a* is pivotable right and left in response to the operation of the steering handle 8. The impeller 51 is attached to the rear portion of the impeller shaft 50. The impeller 51 is disposed inside the impeller housing 52. The impeller 51 is configured to rotate together with the impeller shaft 50 and suck in water through the water suction unit 2*e*. The impeller 51 is configured to rearwardly eject the sucked in water out of a jet port 53*b* of the steering nozzle 53*a*.

The bucket 54 is disposed rearward of the nozzle 53. The bucket 54 is configured to switch the direction of the jet of water ejected out of the jet port 53*b* to the forward direction and the right-and-left direction.

Figure 2A:
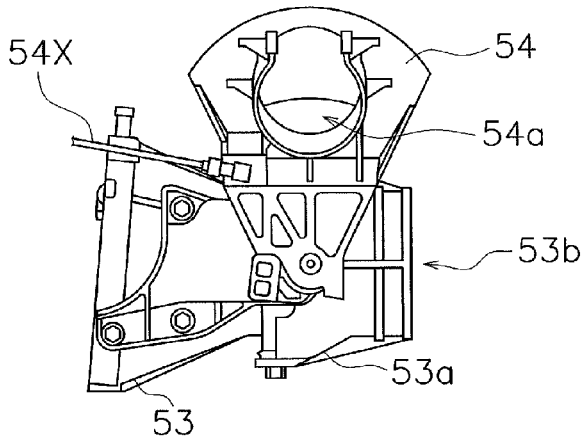
FIGS. 2A to 2C are partial side views of a propulsion mechanism of the jet propelled watercraft.
Figure 2B:
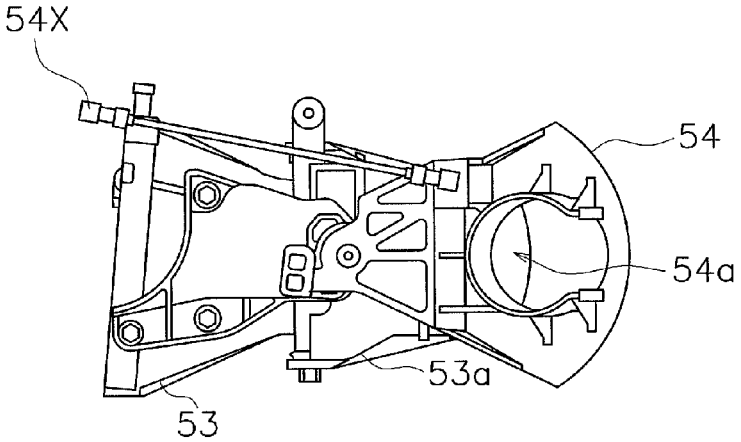
Figure 2C:
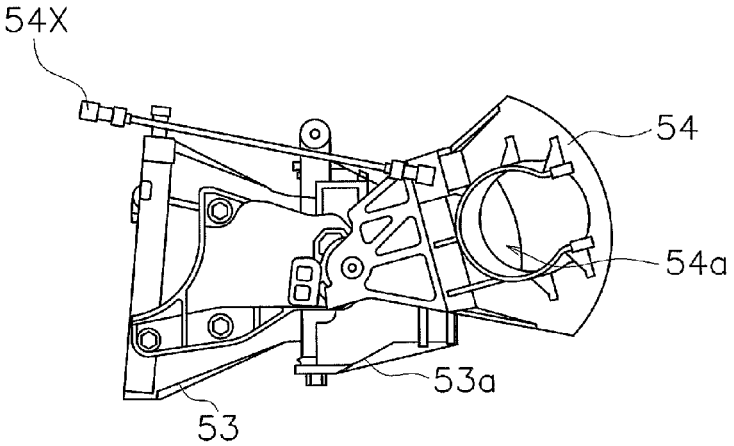
Figure 3:
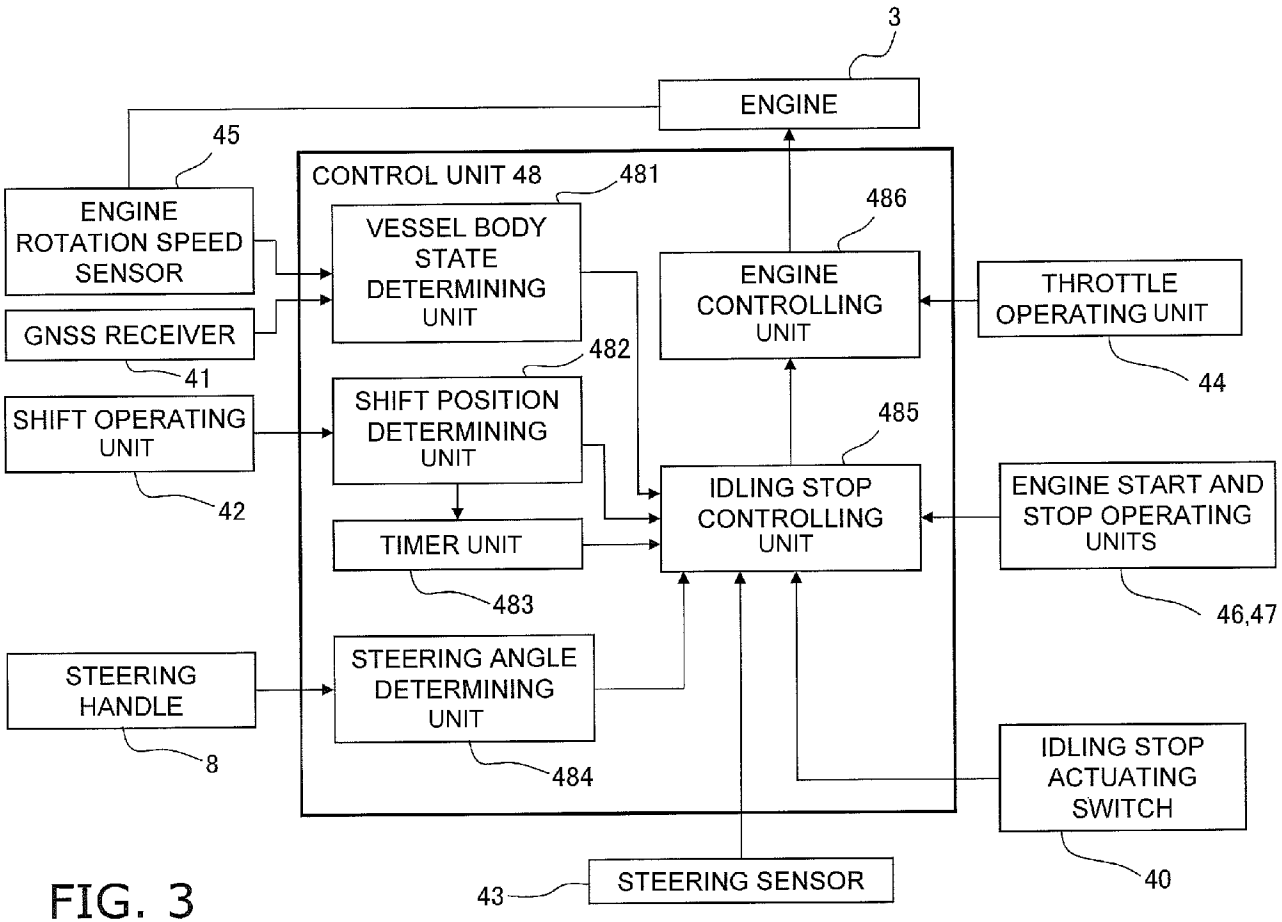
FIG. 3 is a block diagram representing a control system of the jet propelled watercraft.

FIGS. 2A to 2C are partial side views of the propulsion mechanism 5. FIG. 3 is a block diagram representing a control system of the jet propelled watercraft 1. As illustrated in FIG. 2, the bucket 54 is attached to the nozzle 53 through a link mechanism 54X. In conjunction with the driving of the link mechanism 54X by an electric motor, the bucket 54 is configured to move to a first bucket position to cause the jet of water to flow rearward, a second bucket position to cause the jet of water to flow forward, or a third bucket position that is different from the first and second bucket positions.

FIG. 2A illustrates a condition in which the bucket 54 is located in the first bucket position. When located in the first bucket position, the bucket 54 is retracted from a position opposed to the jet port 53*b*. Therefore, the bucket 54, located in the first bucket position, causes the jet of water ejected out of the jet port 53*b* to flow rearward without changing the flow direction of the jet of water. As a result, the vessel body 2 is moved forward.

FIG. 2B illustrates a condition in which the bucket 54 is located in the second bucket position. When located in the second bucket position, the bucket 54 is disposed immediately rearward of the jet port 53 so as to be opposed thereto. Therefore, the bucket 54, located in the second bucket position, changes the flow direction of the jet of water ejected out of the jetport 53*b* and causes the jet of water to flow forward. As a result, the vessel body 2 is moved rearward.

FIG. 2C illustrates a condition in which the bucket 54 is located in the third bucket position. In the present preferred embodiment, the third bucket position corresponds to an intermediate position between the first bucket position and the second bucket position. When located in the third bucket position, only the lower portion of the bucket 54 is opposed to the jet port 53*b*. Therefore, the bucket 54, located in the third bucket position, causes the upper side of the jet of water ejected out of the jet port 53*b* to flow forward while causing the lower side of the jet of water to flow rearward. As a result, the forward stream and the rearward stream of the jet of water are balanced, and thus, the vessel body 2 maintains a stationary state.

It should be noted that as illustrated in FIGS. 2A to 2C, the bucket 54 includes a pair of lateral openings 54*a* opened to the right and left. When the bucket 54 is located in either the second bucket position or the third bucket position, the jet of water also partially flows out of the pair of lateral openings 54*a*. It should be noted that the bucket 54 is not necessarily required to include the pair of lateral openings 54*a*.

As represented in FIG. 3, the jet propelled watercraft 1 includes an idling stop actuating switch 40, a GNSS receiver 41, a shift operating unit 42, a steering sensor 43, a throttle operating unit 44, an engine rotation speed sensor 45, an engine start operating unit 46, an engine stop operating unit 47, and a control unit 48. The idling stop actuating switch 40, the shift operating unit 42, the throttle operating unit 44, the engine start operating unit 46, and the engine stop operating unit 47 are operated by an operator.

The idling stop actuating switch 40 switches an idling stop function between an activated state and a deactivated state. The idling stop function is a function of automatically stopping the engine 3 when the jet propelled watercraft 1 is temporarily stopped. For example, the idling stop actuating switch 40 is attached to the steering handle 8. Whenever the idling stop actuating switch 40 is pressed down, an activation signal and a deactivation signal are alternately outputted to the control unit 48.

The GNSS receiver 41 is configured to receive a positional coordinate signal from satellites of GNSS (Global Navigation Satellite System) such as GPS (Global Positioning System), and is configured to determine the present position of the jet propelled watercraft 1 based on the received positional coordinate signal. The GNSS receiver 41 is configured to output a present position signal, indicating the present position of the jet propelled watercraft 1, to the control unit 48.

The shift operating unit 42 is movable to a forward thrust position, a rearward thrust position, and a neutral position. When the shift operating unit 42 is switched into the forward thrust position, the bucket 54 is moved to the first bucket position (see FIG. 2A) and the propulsion mechanism 5 is switched into the forward thrust state. When the shift operating unit 42 is switched into the rearward thrust position, the bucket 54 is moved to the second bucket position (see FIG. 2B) and the propulsion mechanism 5 is switched into the rearward thrust state. When the shift operating unit 42 is switched into the neutral position, the bucket 54 is moved to the third bucket position (see FIG. 2C) and the propulsion mechanism 5 is switched into the neutral state. The shift operating unit 42 is configured to output a shift position signal, indicating the position of the shift operating unit 42, to the control unit 48.

The steering sensor 43 is configured to detect that the steering handle 8 is being held by a vessel operator. For example, a touch sensor of a resistance film type, an infrared type, a surface acoustic wave (SAW) type, or an electrostatic type can be herein used as the steering sensor 43. The steering sensor 43 is embedded in, for instance, the pair of handles 8*a* of the steering handle 8. The steering sensor 43 is configured to output a holding signal, indicating that the steering handle 8 is being held by a vessel operator, to the control unit 48.

The throttle operating unit 44 is an operating member configured to regulate the rotation speed of the engine 3. For example, the throttle operating unit 44 is a lever attached to the steering handle 8. The throttle operating unit 44 is configured to output a throttle operating signal, indicating the operation amount of the throttle operating unit 44, to the control unit 48.

The engine rotation speed sensor 45 is configured to detect the rotation speed of the engine 3. For example, a pickup sensor (e.g., a crank angle sensor, a crank position sensor, a cam position sensor, a gear tooth sensor, etc.) can be used as the engine rotation speed sensor 45. The engine rotation speed sensor 45 is configured to output an engine rotation speed signal, indicating the rotation speed of the engine 3, to the control unit 48.

The engine start operating unit 46 is a member configured to start the engine 3. For example, the engine start operating unit 46 is a switch. When pressed down, the engine start operating unit 46 is configured to output an engine start signal to the control unit 48. The engine stop operating unit 47 is a member configured to stop the engine 3. For example, the engine stop operating unit 47 is a switch. When pressed down, the engine stop operating unit 47 is configured to output an engine stop signal to the control unit 48.

The control unit 48 includes a computer including a CPU, a memory and so forth. As represented in FIG. 3, the control unit 48 is configured and programmed to include a vessel body state determining unit 481, a shift position determining unit 482, a timer unit 483, a steering angle determining unit 484, an idling stop controlling unit 485, and an engine controlling unit 486.

The vessel body state determining unit 481 is programmed and configured to determine whether or not the vessel body 2 is in a stationary state based on the present position signal from the GNSS receiver 41 and the engine rotation speed signal from the engine rotation speed sensor 45. Specifically, the vessel body state determining unit 481 is programmed and configured to determine that the vessel body 2 is in the stationary state when the speed of the vessel body 2 (hereinafter referred to as "vessel speed"), calculated based on the present position signal, is less than or equal to a predetermined speed (e.g., about 5 km/h) while the rotation speed of the engine 3, indicated by the engine rotation speed signal, is less than or equal to a predetermined speed (e.g., about 1,000 rpm). The vessel body state determining unit 481 is programmed and configured to output a stationary state signal, indicating that the vessel body 2 is in the stationary state, to the idling stop controlling unit 485.

The shift position determining unit 482 is programmed and configured to determine whether or not the shift operating unit 42 is set in the neutral position based on the shift position signal from the shift operating unit 42. When the shift operating unit 42 is set in the neutral position, the shift position determining unit 482 is programmed and configured to output a neutral signal, indicating that the shift operating unit 42 is set in the neutral position, to the timer unit 483. The shift position determining unit 482 is programmed and configured to output a non-neutral signal to the timer unit 483 and the idling stop controlling unit 485 when the shift operating unit 42 is switched from the neutral position to either the forward thrust position or the rearward thrust position.

When receiving the neutral signal from the shift position determining unit 482, the timer unit 483 is configured to start counting a period of time that the shift operating unit 42 is maintained in the neutral position. When the cumulative time that the shift operating unit 42 is maintained in the neutral position exceeds a predetermined period of time (e.g., about 10 seconds), the timer unit 483 is configured to output a neutral state maintaining signal, indicating that the cumulative time exceeds the predetermined period of time, to the idling stop controlling unit 485. When receiving the non-neutral signal from the shift position determining unit 482, the timer unit 483 is configured to finish counting the cumulative time.

The steering angle determining unit 484 is programmed and configured to determine whether or not the steering angle of the steering handle 8 is less than or equal to a predetermined angle (e.g., about 30 degrees). Moreover, the steering angle determining unit 484 is programmed and configured to determine whether or not the steering angle of the steering handle 8 has been maintained at the predetermined angle or less for a predetermined period of time (e.g., about 10 seconds). The steering angle determining unit 484 is programmed and configured to output either a non-steering signal or a steering signal to the idling stop controlling unit 485. The non-steering signal herein indicates that the steering angle has been maintained at the predetermined angle or less for the predetermined period of time, whereas the steering signal indicates that the steering angle has not been maintained at the predetermined angle or less for the predetermined period of time.

The idling stop controlling unit 485 is programmed and configured to output an idling stop activating signal, indicating that the engine 3 should be temporarily stopped, to the engine controlling unit 486 when receiving all of the signals including: the activation signal from the idling stop actuating switch 40; the neutral state maintaining signal from the timer unit 483; the stationary state signal from the vessel body state determining unit 481; and the non-steering signal from the steering angle determining unit 484. When not receiving even one of the aforementioned signals, the idling stop controlling unit 485 is programmed and configured not to output the idling stop activating signal to the engine controlling unit 486.

After outputting the idling stop activating signal to the engine controlling unit 486, the idling stop controlling unit 485 is programmed and configured to output an idling stop deactivating signal to the engine controlling unit 486 when receiving at least one of the signals including: the deactivation signal from the idling stop actuating switch 40; the non-neutral signal from the shift position determining unit 482; and the holding signal from the steering sensor 43.

The engine controlling unit 486 is programmed and configured to start the engine 3 in response to the engine start signal from the engine start operating unit 46. After starting the engine 3, the engine controlling unit 486 is programmed and configured to regulate the rotation speed of the engine 3 in response to the throttle operating signal from the throttle operating unit 44. The engine controlling unit 486 is programmed and configured to stop the engine 3 in response to the engine stop signal from the engine stop operating unit 47. When stopping the engine 3 in response to the engine stop signal, the engine controlling unit 486 is programmed and configured not to start the engine 3 until the engine start signal is inputted again.

After starting the engine 3, the engine controlling unit 486 is programmed and configured to temporarily stop the engine 3 in response to the idling stop activating signal from the idling stop controlling unit 485. After temporarily stopping the engine 3, the engine controlling unit 486 is programmed and configured to restart the engine 3 in response to the idling stop deactivating signal from the idling stop controlling unit 485.

Figure 4:
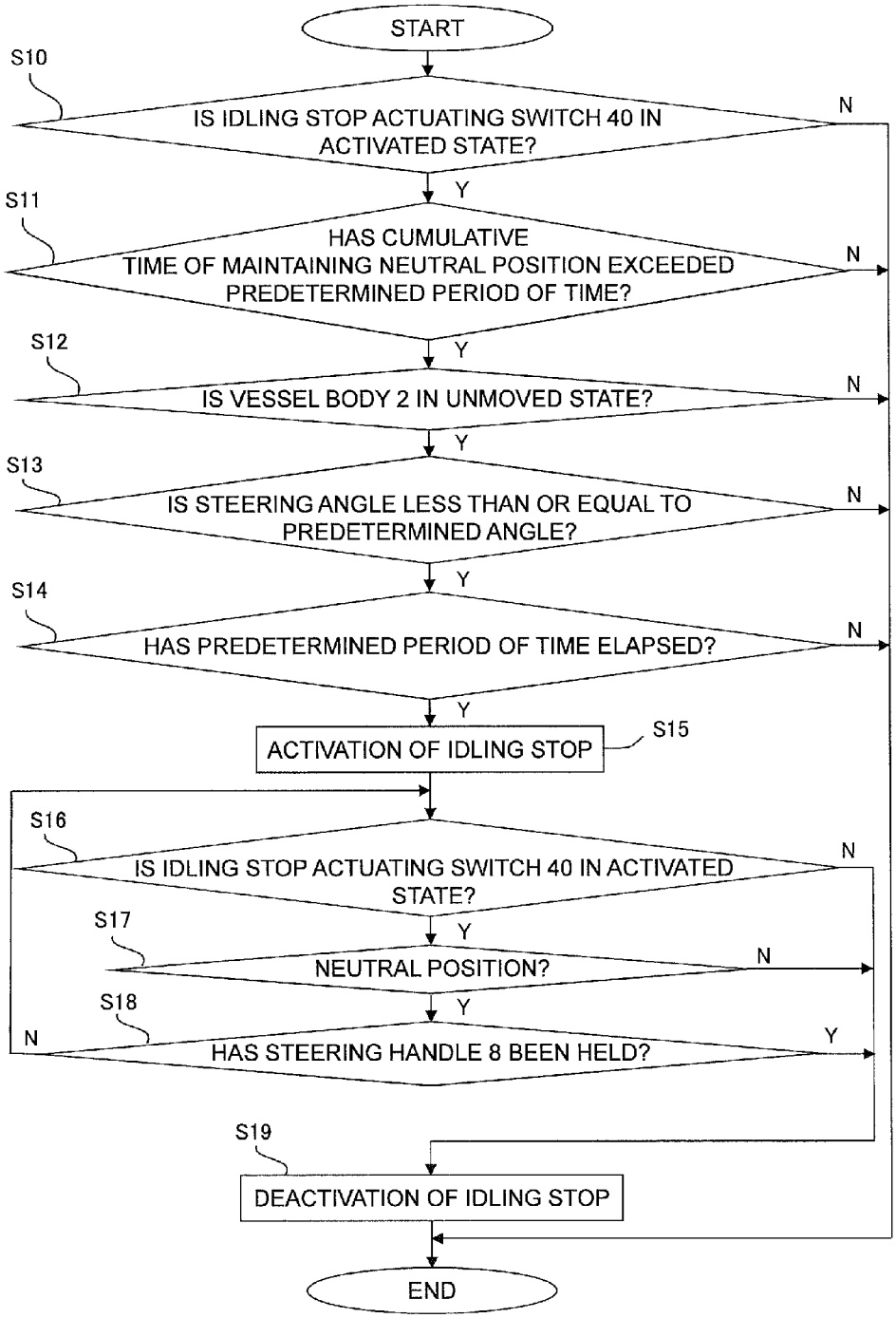
FIG. 4 is a flowchart representing an idling stop activation process and an idling stop deactivation process.

Explanation will be hereinafter made for an idling stop activation process and an idling stop deactivation process performed by the control unit 48. FIG. 4 is a flowchart representing a process of activating and deactivating the idling stop. It should be noted that in the following explanation, the engine 3 is assumed to be operating.

In Step S10, the control unit 48 determines whether or not the idling stop actuating switch 40 is set in the activated state. The process proceeds to Step S11 when it is determined that the idling stop actuating switch 40 is set in the activated state. By contrast, the process ends when it is determined that the idling stop actuating switch 40 is set in the deactivated state.

In Step S11, the control unit 48 determines whether or not the cumulative time that the shift operating unit 42 is maintained in the neutral position has exceeded a predetermined period of time. The process proceeds to Step S12 when it is determined that the cumulative time has exceeded the predetermined period of time. By contrast, the process ends when it is determined that the cumulative time is less than or equal to the predetermined period of time.

In Step S12, the control unit 48 determines whether or not the vessel body 2 is in the stationary state. The process proceeds to Step S13 when it is determined that the vessel body 2 is in the stationary state. By contrast, the process ends when it is determined that the vessel body 2 is in a cruising state.

In Step S13, the control unit 48 determines whether or not the rightward/leftward steering angle of the steering handle 8 is less than or equal to a predetermined angle. The process proceeds to Step S14 when it is determined that the steering angle is less than or equal to the predetermined angle. By contrast, the process ends when it is determined that the steering angle is greater than the predetermined angle.

In Step S14, the control unit 48 determines whether or not a predetermined period of time (e.g., about 10 seconds) has elapsed while the steering angle of the steering handle 8 has been less than or equal to the predetermined angle. The process proceeds to Step S15 when it is determined that the predetermined period of time has elapsed. By contrast, the process ends either when it is determined that the predetermined period of time has not elapsed yet or when it is determined that the steering angle of the steering handle 8 has become greater than the predetermined angle before the elapse of the predetermined period of time.

In Step S15, the control unit 48 activates idling stop and temporarily stops the engine 3.

In Step S16, the control unit 48 determines whether or not the idling stop actuating switch 40 is set in the activated state. The process proceeds to Step S17 when it is determined that the idling stop actuating switch 40 is set in the activated state. By contrast, the process proceeds to Step S19 when it is determined that the idling stop actuating switch 40 is set in the deactivated state.

In Step S17, the control unit 48 determines whether or not the shift operating unit 42 is set in the neutral position. The process proceeds to Step S18 when it is determined that the shift operating unit 42 is set in the neutral position. By contrast, the process proceeds to Step S19 when it is determined that the shift operating unit 42 is set in any of the positions other than the neutral position.

In Step S18, the control unit 48 determines whether or not the steering handle 8 is being held by a vessel operator. The process returns to Step S15 when it is determined that the steering handle 8 is not being held by the vessel operator. Then in Step S15, idling stop is continued to be activated. By contrast, the process proceeds to Step S19 when it is determined that the steering handle 8 is being held by the vessel operator.

In Step S19, the control unit 48 deactivates the idling stop and restarts the engine 3.

As described above, the engine controlling unit 486 is programmed and configured to temporarily stop the engine 3 when the shift operating unit 42 is set in the neutral position and the vessel body 2 is in the stationary state. Thus, the engine controlling unit 486 sets the position of the shift operating unit 42 and the navigational state of the vessel body 2 as conditions to activate the idling stop. Therefore, an intention to operate the vessel is reflected in the process of activating the idling stop in the jet propelled watercraft 1 that is not equipped with a brake pedal or the like.

The engine controlling unit 486 is programmed and configured to temporarily stop the engine 3 when the cumulative time that the shift operating unit 42 is maintained in the neutral position has exceeded a predetermined period of time. Thus, the fact that the shift operating unit 42 has been maintained in the neutral position is set as a condition to activate the idling stop. Idling stop is not activated when the shift operating unit 42 has been only switched instantaneously into the neutral position. Therefore, the intention to operate the vessel is more accurately reflected in the process of activating the idling stop.

The engine controlling unit 486 is programmed and configured to temporarily stop the engine 3 when the steering angle of the steering handle 8 is less than or equal to a predetermined angle. Thus, the fact that the steering handle 8 has not been operated is set as a condition to activate the idling stop. Idling stop is not activated when the steering handle 8 is being turned right or left. Therefore, the intention to operate the vessel is further reflected in the process of activating the idling stop.

The engine controlling unit 486 is programmed and configured to restart the engine 3 either when the shift operating unit 42 has been switched from the neutral position to any of the other positions or when the steering handle 8 is being held by the vessel operator. Thus, the engine controlling unit 486 sets the position of the shift operating unit 42 or the fact that the vessel operator has taken a position of a vessel operation preparatory state as a condition to deactivate the idling stop. Therefore, the process of deactivating the idling stop is quickly performed.

The first preferred embodiment of the present invention has been explained above. However, the present invention is not limited to the above described first preferred embodiment, and a variety of changes can be made without departing from the scope of the present invention.

In the above described first preferred embodiment, the vessel body state determining unit 481 is preferably programmed and configured to determine that the vessel body 2 is in the stationary state when the vessel speed is less than or equal to a predetermined speed and the engine rotation speed is less than or equal to a predetermined speed. However, the configuration of determining the stationary state of the vessel body 2 is not limited to the above. The vessel body state determining unit 481 may be programmed and configured to determine that the vessel body 2 is in the stationary state either only when the vessel speed is less than or equal to the predetermined speed or only when the engine rotation speed is less than or equal to the predetermined speed.

In the above described first preferred embodiment, the fact that the cumulative time that the shift operating unit 42 is maintained in the neutral position has exceeded a predetermined period of time and the fact that the steering angle of the steering handle 8 is less than or equal to a predetermined angle are preferably set as conditions to activate the idling stop. However, these are not necessarily the only conditions to activate the idling stop. In other words, the idling stop may be activated simultaneously when the shift operating unit 42 is switched into the neutral position or while the steering handle 8 is being turned to the right or left.

In the above described first preferred embodiment, the fact that the shift operating unit 42 is set in the neutral position is preferably a condition to activate the idling stop.

However, in addition to, the bucket 54 being actually located in the third bucket position may be set as a condition to activate the idling stop.

In the above described first preferred embodiment, the fact that the steering handle 8 is being held by the vessel operator is preferably a condition to deactivate the idling stop. However, in addition to or instead, the throttle operating unit 44 having been operated and/or the steering angle of the steering handle 8 having become greater than a predetermined angle may be set as conditions or a condition to deactivate the idling stop.

Second Preferred Embodiment

Figure 5:
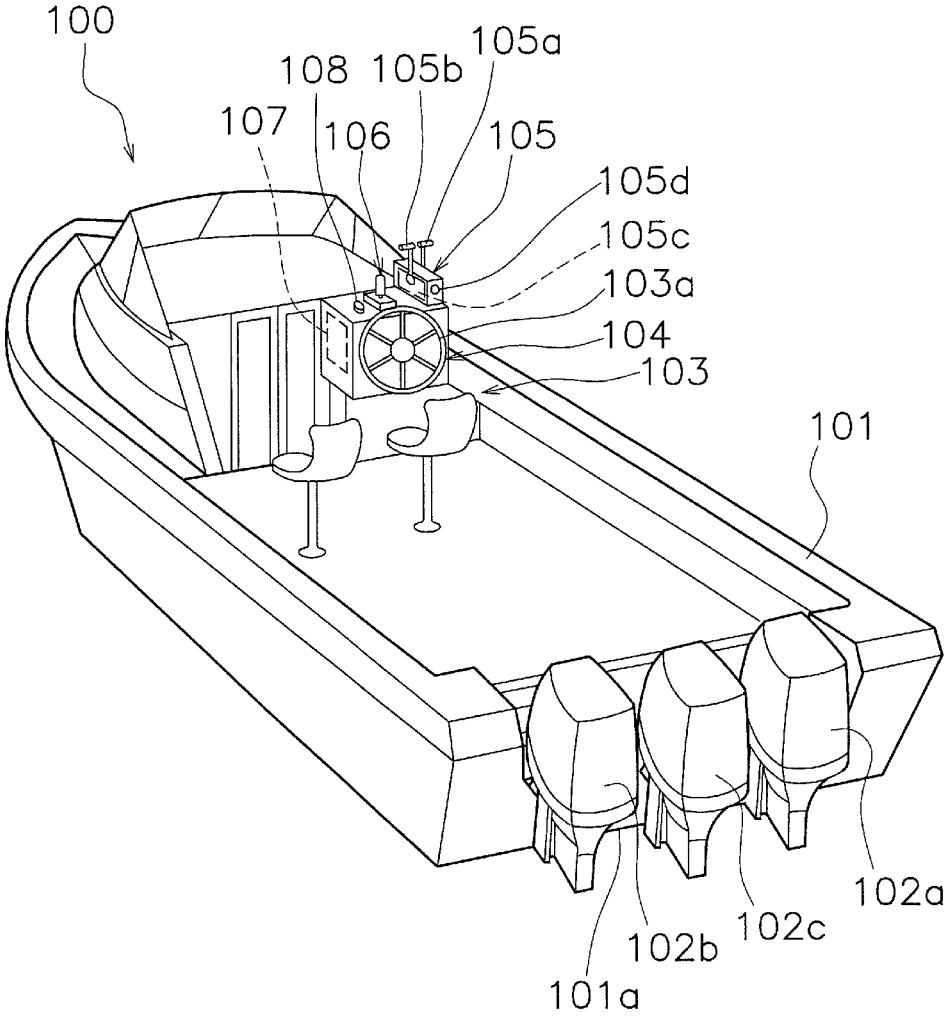
FIG. 5 is a perspective view of a schematic structure of a watercraft according to a second preferred embodiment of the present invention.
Figure 6:
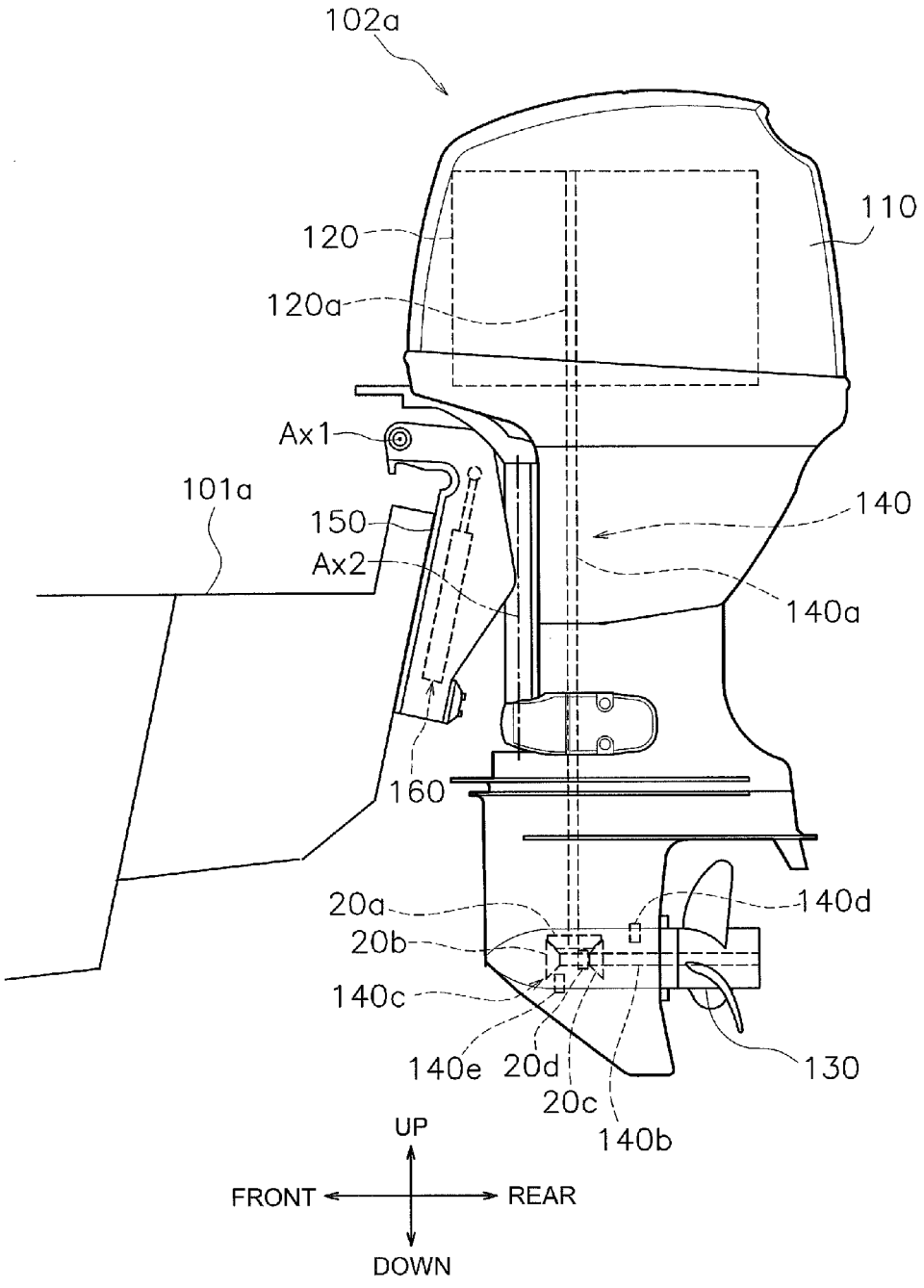
FIG. 6 is a side view of an S motor.

With reference to the drawings, explanation will be hereinafter made for a watercraft as an exemplary watercraft. FIG. 5 is a perspective view of a watercraft 100. FIG. 6 is a side view of an S motor 3*a*.

As illustrated in FIG. 5, the watercraft 100 includes a vessel body 101 and S, P, and C motors (outboard motors) 102*a* to 102*c*.

The vessel body 101 includes a cockpit 103. A steering device 104, a remote control device 105, a joystick 106, a control unit 107, an idling stop actuating switch 108 are disposed in the cockpit 103. The steering device 104 allows an operator to manipulate the turning direction of the watercraft 100. The steering device 104 includes a steering member 103*a*. For example, the steering member 103*a* is preferably a handle. The steering member 103*a* sets target steering angles of the S, P, and C motors 102*a* to 102*c*.

The remote control device 105 allows an operator to change the moving direction of the vessel body 101 and to regulate the speed of the vessel body 101 (hereinafter referred to as a vessel speed). The remote control device 105 includes a first operating member 105*a*, a second operating member 105*b*, a shift lock unit 105*c*, and a shift unlock unit 105*d*. For example, the first and second operating members 105*a* and 105*b* are levers that are tilted back and forth. The first and second operating members 105*a* and 105*b* function as a shift operating unit to change the moving direction of the vessel body 101 and a throttle operating unit to regulate the vessel speed.

Figure 7:
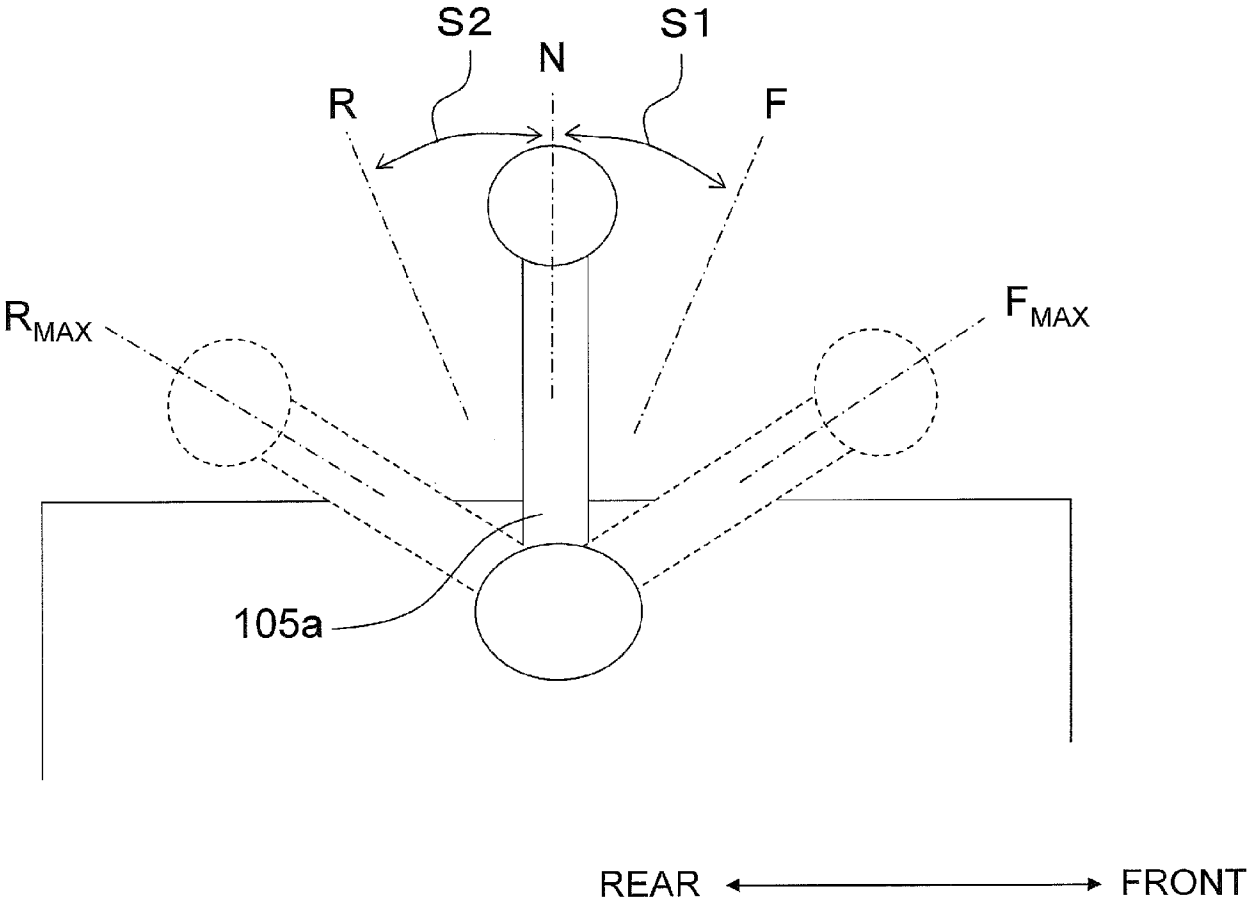
FIG. 7 is a diagram for explaining a tilt range of a first operating member.

FIG. 7 is a diagram for explaining the tilt range of the first operating member 105*a*. The first operating member 105*a* is configured to be tilted about a neutral position N from a maximum forwardly tilted position $F_{MAX}$ to a maximum rearwardly tilted position $R_{MAX}$. A forward thrust position F is set in a position between the neutral position N and the maximum forwardly tilted position $F_{MAX}$. A first detection region S1 is a region between the neutral position N and the forward thrust position F. In the first detection region S1, it is detected that the first operating member 105*a* has been moved from the neutral position N. A rearward thrust position R is set in a position between the neutral position N and the maximum rearwardly tilted position $R_{MAX}$. A second detection region S2 is a region between the neutral position N and the rearward thrust position R. In the second detection region S2, it is detected that the first operating member 105*a* has been moved from the neutral position N. A shift position signal indicating the position of the first operating member 105*a* is outputted to the control unit 107. When the first operating member 105*a* is tilted across either the forward thrust position F or the rearward thrust position R, a throttle operating signal indicating the operation amount of the first operating member 105*a* is outputted to the control unit 107. Accordingly, an engine 120 and a propulsion mechanism 140 of the S motor 102*a* are controlled.

The second operating member 105*b* is structurally similar to the first operating member 105*a*. An engine and a propulsion mechanism (not illustrated in the drawings) of the P (port) motor 102*b* are controlled in response to an operation of the second operating member 105*b*. It should be noted that an engine and a propulsion mechanism of the C motor 102*c* are controlled in response to an operation of the first operating member 105*a* and that of the second operating member 105*b*. For example, when the shift position of the first operating member 105*a* and that of the second operating member 105*b* are matched, the propulsion mechanism of the C motor 102*c* is switched into the shift position, and accordingly, the engine rotation speed of the C motor 102*c* is set to the average of the engine rotation speed of the S motor 102*a* and that of the P motor 102*b*. By contrast, when the shift position of the first operating member 105*a* and that of the second operating member 105*b* are not matched, the propulsion mechanism of the C motor 102*c* is switched into the neutral position, and accordingly, the engine rotation speed of the C motor 102*c* is set to an idling rotation speed.

When each of the first and second operating members 105*a* and 105*b* is switched into the neutral position N, the shift lock unit 105*c* is configured to lock each of the first and second operating members 105 and 105*b* and prevent movement thereof. The shift unlock unit 105*d* is, for instance, a button. A vessel operator unlocks each of the first and second operating members 105*a* and 105*b* locked by the shift lock unit 105*c* by pressing down the shift unlock unit 105*d*. When the shift unlock unit 105*d* is pressed down, an unlock signal is outputted to the control unit 107.

The joystick 106 allows a vessel operator to manipulate the moving direction of the watercraft 100 at least in each of the front, rear, right, and left directions. The joystick 106 issues instructions of four or more directions, and may be configured to issue instructions in all directions.

The control unit 107 is programmed and configured to control the S (starboard), P (port), and C (center) motors 102*a* to 102*c* in response to the operation signals from the steering device 104, the remote control device 105, and the joystick 106. The control unit 107 includes a computer including a CPU, a memory and so forth. It should be noted that explanation will be made below of an idling stop control performed by the control unit 107.

The idling stop actuating switch 108 switches activation and deactivation of the idling stop functions in the S, P, and C motors 102*a* to 102*c*. Whenever the idling stop actuating switch 108 is pressed down, an activation signal and a deactivation signal are alternately outputted to the control unit 107.

The S, P, and C motors 102*a* to 102*c* are attached to a transom 101*a* of the vessel body 101. The S, P, and C motors 102*a* to 102*c* are aligned in the right-and-left direction of the vessel body 101. The S, P, and C motors 102*a* to 102*c* are configured to generate thrust to propel the watercraft 100. The structure of the P motor 102*b* and that of the C motor 102*c* are similar to that of the S motor 102*a*. Therefore, explanation will be mainly made of the structure of the S motor 102*a*.

As illustrated in FIG. 6, the S motor 102*a* includes a cover member 110, the engine 120, a propeller 130, the propulsion mechanism 140, a bracket 150, and a first PTT (Power Tilt and Trim) device 160.

The cover member 110 accommodates the engine 120 and the propulsion mechanism 140. The engine 120 is disposed in the upper unit of the S motor 102*a*. The propeller 130 is disposed in the lower unit of the S motor 102*a*. The propeller 130 is configured to be driven and rotated by the driving force of the engine 120 transmitted thereto through the propulsion mechanism 140.

The propulsion mechanism 140 includes a drive shaft 140*a*, a propeller shaft 140*b*, a shift mechanism 140*c*, a propeller shaft rotation speed sensor 140*d*, and a clutch position sensor 140*e*. The drive shaft 140*a* extends in the up-and-down direction. The drive shaft 140*a* is coupled to a crankshaft 120*a* of the engine 120. The propeller shaft 140*b* is configured to be rotated by the driving force of the engine 120 transmitted thereto through the drive shaft 140*a* and the shift mechanism 140*c*. The shift mechanism 140*c* is mounted to the front end portion of the propeller shaft 140*b*. The propeller 130 is fixed onto the rear end portion of the propeller shaft 140*b*. The driving force of the engine 120 is transmitted to the propeller 130 through the drive shaft 140*a*, the shift mechanism 140*c*, and the propeller shaft 140*b*, in this order.

The shift mechanism 140*c* is configured to switch the rotational direction of the power transmitted from the drive shaft 140*a* to the propeller shaft 140*b* by switching the engaged/disengaged state between the drive shaft 140*a* and the propeller shaft 140*b*. The shift mechanism 140*c* includes a pinion gear 20*a*, a forward thrust gear 20*b*, a rearward thrust gear 20*c*, and a dog clutch 20*d*. The pinion gear 20*a* is coupled to the lower end of the drive shaft 140*a*. The pinion gear 20*a* is meshed with the forward thrust gear 20*b* and the rearward thrust gear 20*c*. The forward thrust gear 20*b* and the rearward thrust gear 20*c* are rotatable relative to the propeller shaft 140*b*. The dog clutch 20*d* is movable along the propeller shaft 140*b*, while being mounted thereto. The dog clutch 20*d* is movable to a first engaged position, a second engaged position, and a disengaged position. When the dog clutch 20*d* is in the first engaged position, the propeller shaft 140*b* is caused to be engaged with the drive shaft 140*a* such that the propeller shaft 140*b* is rotated in the direction of forwardly moving the vessel body 101. When the dog clutch 20*d* is in the second engaged position, the propeller shaft 140*b* is caused to be engaged with the drive shaft 140*a* such that the propeller shaft 140*b* is rotated in the direction of rearwardly moving the vessel body 101. When the dog clutch 20*d* is in the disengaged position, the propeller shaft 140*b* is caused to be spaced apart from the drive shaft 140*a*. In other words, the drive shaft 140*a* is turned into a free-wheeling state, and thus, the propeller shaft 140*b* is not rotated.

The propeller shaft rotation speed sensor 140*d* is configured to detect the rotation speed of the propeller shaft 140*b*. The propeller shaft rotation speed sensor 140*d* is configured to output a propeller shaft rotation speed signal, indicating the rotation speed of the propeller shaft 140*b*, to the control unit 107.

The clutch position sensor 140*e* is configured to detect the position of the dog clutch 20*d*. The clutch position sensor 140*e* is configured to output a disengaging signal and an engaging signal to the control unit 107. The disengaging signal indicates that the dog clutch 20*d* is in the disengaged position, whereas the engaging signal indicates that the dog clutch 20*d* is in either the first engaged position or the second engaged position.

The bracket 150 is a mechanism to attach the S motor 102*a* to the transom 101*a*. The S motor 102*a* is attached to the transom 101*a* so as to be rotatable up and down about a tilt axis Ax1 extending in the right-and-left direction of the vessel body 2. A trim angle and a tilt angle vary in accordance with rotation of the S motor 102*a* about the tilt axis Ax1. Also, the S motor 102*a* is attached to the transom 101*a* so as to be rotatable right and left about a steering axis Ax2. The first PTT device 160 causes the S motor 102*a* to be driven and rotated about the tilt axis Ax1.

Figure 8:
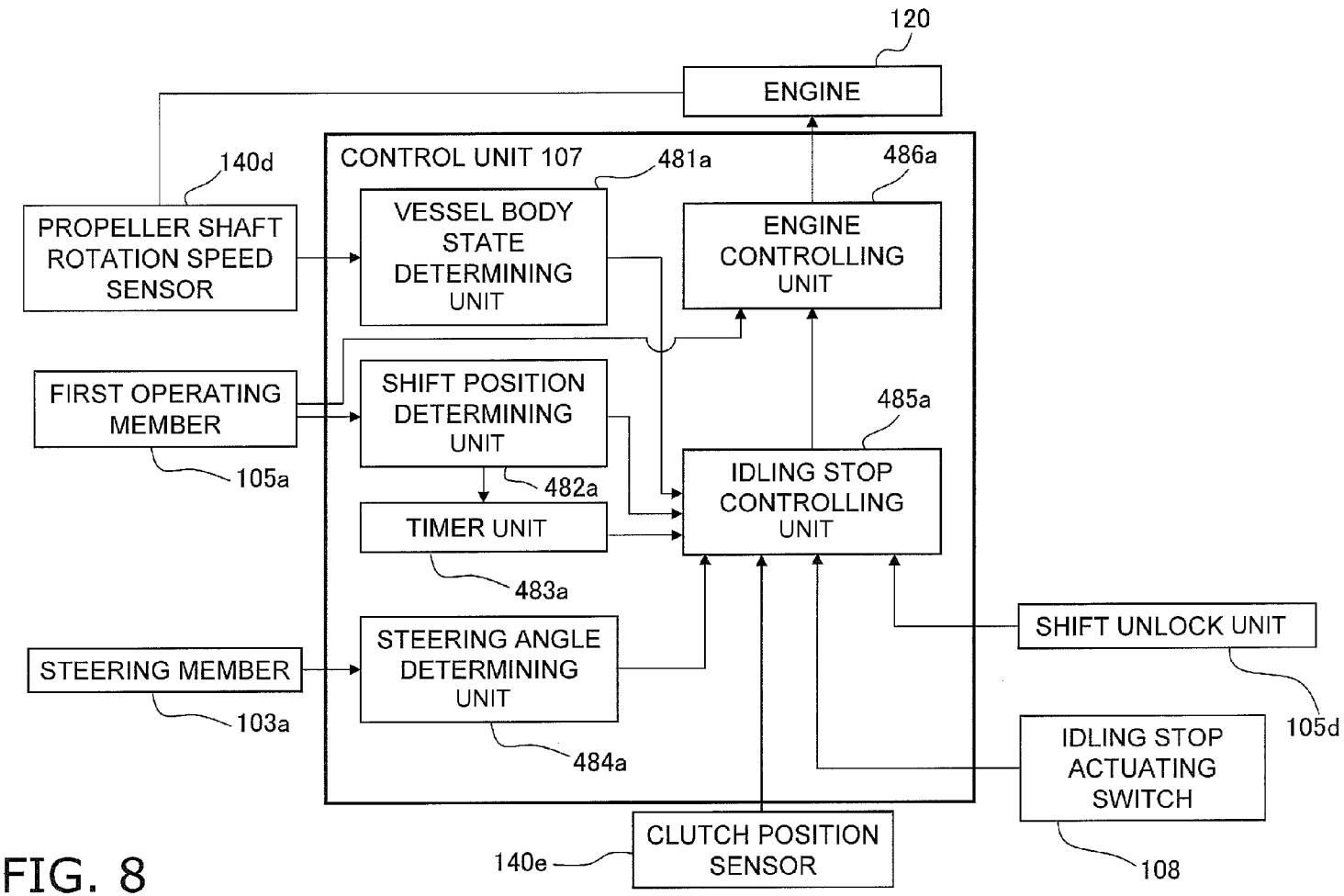
FIG. 8 is a block diagram representing a control system of the watercraft.

With reference to the drawings, explanation will be hereinafter made of a configuration of the control unit 107. FIG. 8 is a block diagram of a control system of the watercraft 100.

The control unit 107 includes a vessel body state determining unit 481*a*, a shift position determining unit 482*a*, a timer unit 483*a*, a steering angle determining unit 484*a*, an idling stop controlling unit 485*a*, and an engine controlling unit 486*a*.

The vessel body state determining unit 481*a* is programmed and configured to determine whether or not the vessel body 101 is in a stationary state based on the propeller shaft rotation speed signal from the propeller shaft rotation speed sensor 140*d*. Specifically, the vessel body state determining unit 481*a* is programmed and configured to determine that the vessel body 101 is in the stationary state when the rotation speed of the propeller shaft 140*b* is less than or equal to a predetermined rotation speed (e.g., about 50 rpm). The vessel body state determining unit 481*a* is programmed and configured to output a stationary state signal, indicating that the vessel body 101 is in the stationary state, to the idling stop controlling unit 485*a*.

The shift position determining unit 482*a* is programmed and configured to determine the shift position of the first operating member 105*a* based on the shift position signal from the first operating member 105*a*. When the first operating member 105*a* is in the neutral position N, the shift position determining unit 482*a* is programmed and configured to output a neutral signal, indicating the state of the first operating member 105*a*, to the timer unit 483*a*. When the first operating member 105*a* has been moved from the neutral position N, the shift position determining unit 482*a* is programmed and configured to output a non-neutral signal to the timer unit 483*a* and the idling stop controlling unit 485*a*.

When receiving the neutral signal from the shift position determining unit 482*a*, the timer unit 483*a* is configured to start counting a cumulative time that the first operating member 105*a* is maintained in the neutral position. When the cumulative time has exceeded a predetermined period of time (e.g., about 10 seconds), the timer unit 483*a* is configured to output a neutral state maintaining signal, indicating that the cumulative time has exceeded the predetermined period of time, to the idling stop controlling unit 485*a*. When receiving the non-neutral signal from the shift position determining unit 482*a*, the timer unit 483*a* is configured to finish counting the cumulative time.

The steering angle determining unit 484*a* is programmed and configured to determine whether or not the steering angle of the steering member 103*a* is less than or equal to a predetermined angle (e.g., 30 degrees). The steering angle determining unit 484*a* is programmed and configured to output either a non-steering signal or a steering signal to the idling stop controlling unit 485*a*. The non-steering signal herein indicates that the steering angle has been maintained at the predetermined angle or less for the predetermined period of time, whereas the steering signal indicates that the steering angle has not been maintained at the predetermined angle or less for the predetermined period of time.

The idling stop controlling unit 485*a* is programmed and configured to output an idling stop activating signal, indicating that the engine 120 should be temporarily stopped, to the engine controlling unit 486*a* when receiving all of the signals including: the activation signal from the idling stop actuating switch 108; the neutral state maintaining signal from the timer unit 483*a*; the stationary state signal from the vessel body state determining unit 481*a*; the non-steering signal from the steering angle determining unit 484*a*; and the disengaging signal from the clutch position sensor 140*e*. When not receiving even one of the aforementioned signals, the idling stop controlling unit 485*a* is programmed and configured not to output the idling stop activating signal to the engine controlling unit 486*a*.

After outputting the idling stop activating signal to the engine controlling unit 486*a*, the idling stop controlling unit 485*a* is programmed and configured to output an idling stop deactivating signal to the engine controlling unit 486*a* when receiving at least one of the signals including: the deactivation signal from the idling stop actuating switch 108; the unlock signal from the shift unlock unit 105*d*; the non-neutral signal from the shift position determining unit 482*a*; and the engaging signal from the clutch position sensor 140*e*.

The engine controlling unit 486*a* is programmed and configured to start the engine 120 in response to an engine start signal from an engine start switch (not illustrated in the drawings). After starting the engine 120, the engine controlling unit 486*a* is programmed and configured to regulate the rotation speed of the engine 120 in response to the throttle operating signal from the first operating member 105*a*. The engine controlling unit 486*a* is programmed and configured to stop the engine 120 in response to an engine stop signal from an engine stop switch (not illustrated in the drawings). When stopping the engine 120 in response to the engine stop signal, the engine controlling unit 486*a* is programmed and configured not to start the engine 120 until the engine start signal is inputted again.

After starting the engine 120, the engine controlling unit 486*a* is programmed and configured to temporarily stop the engine 120 in response to the idling stop activating signal from the idling stop controlling unit 485*a*. After temporarily stopping the engine 120, the engine controlling unit 486*a* is programmed and configured to restart the engine 120 in response to the idling stop deactivating signal from the idling stop controlling unit 485*a*.

Figure 9:
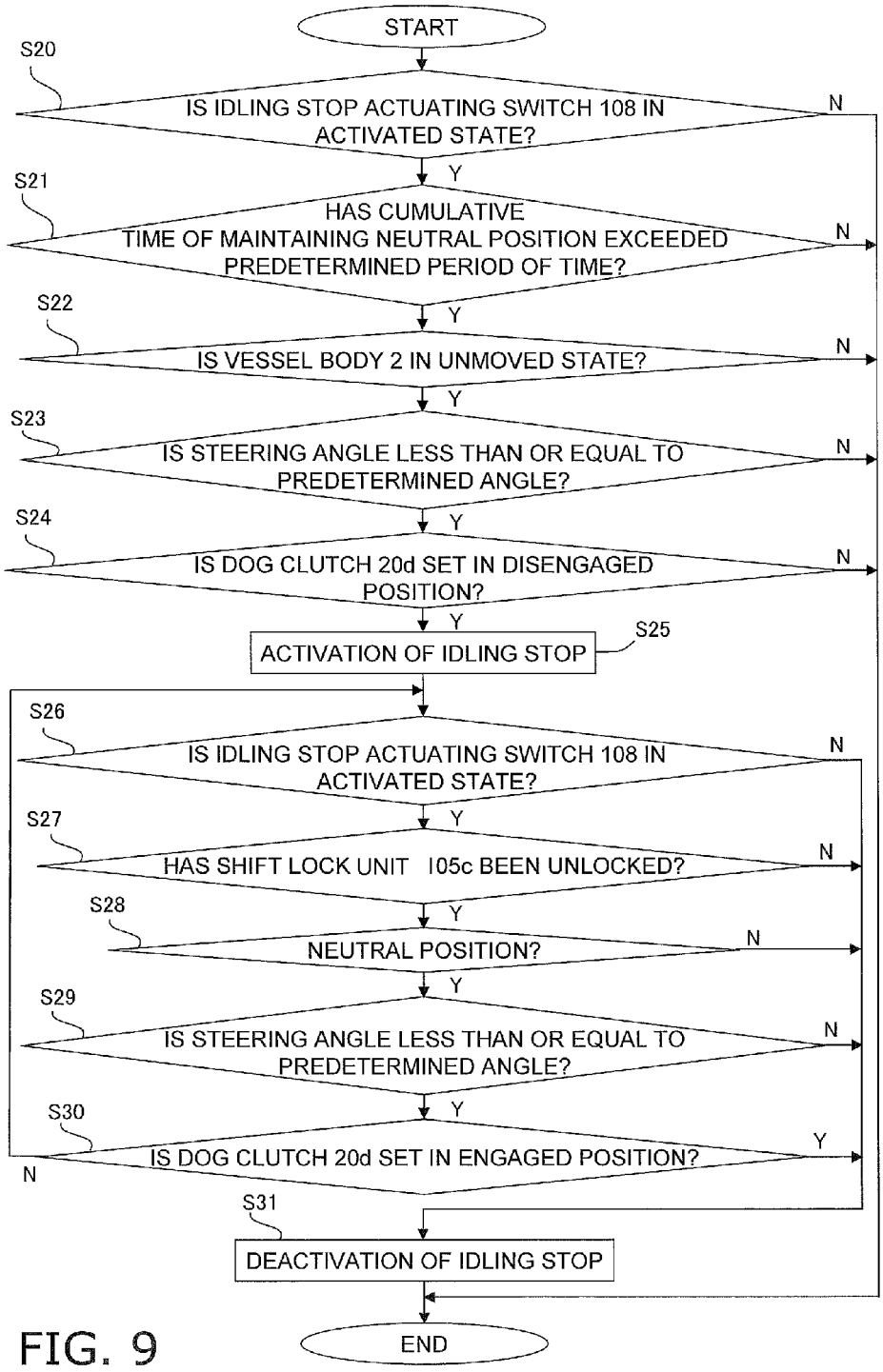
FIG. 9 is a flowchart representing an idling stop activation process and an idling stop deactivation process.

Explanation will be hereinafter made of an idling stop activation process and an idling stop deactivation process performed by the control unit 107. FIG. 9 is a flowchart representing a process of activating and deactivating the idling stop. It should be noted that in the following explanation, the engine 120 is assumed to be operating.

In Step S20, the control unit 107 determines whether or not the idling stop actuating switch 108 is in the activated state. The process proceeds to Step S21 when it is determined that the idling stop actuating switch 108 is in the activated state. By contrast, the process ends when it is determined that the idling stop actuating switch 108 is in the deactivated state.

In Step S21, the control unit 107 determines whether or not the cumulative time that the first operating member 105*a* is maintained in the neutral position has exceeded a predetermined period of time. The process proceeds to Step S22 when it is determined that the cumulative time has exceeded the predetermined period of time. By contrast, the process ends when it is determined that the cumulative time is less than or equal to the predetermined period of time.

In Step S22, the control unit 107 determines whether or not the vessel body 101 is in the stationary state. The process proceeds to Step S23 when it is determined that the vessel body 101 is in the stationary state. By contrast, the process ends when it is determined that the vessel body 101 is in a cruising state.

In Step S23, the control unit 107 determines whether or not the rightward/leftward steering angle of the steering member 103*a* is less than or equal to a predetermined angle. The process proceeds to Step S24 when it is determined that the steering angle is less than or equal to the predetermined angle. By contrast, the process ends when it is determined that the steering angle is greater than the predetermined angle.

In Step S24, the control unit 107 determines whether or not the dog clutch 20*d* is in the disengaged position. The process proceeds to Step S25 when it is determined that the dog clutch 20*d* is in the disengaged position. By contrast, the process ends when it is determined that the dog clutch 20*d* is in the engaged position.

In Step S25, the control unit 107 activates the idling stop and temporarily stops the engine 120.

In Step S26, the control unit 107 determines whether or not the idling stop actuating switch 108 is in the activated state. The process proceeds to Step S27 when it is determined that the idling stop actuating switch 108 is in the activated state. By contrast, the process proceeds to Step S31 when it is determined that the idling stop actuating switch 108 is in the deactivated state.

In Step S27, the control unit 107 determines whether or not the shift lock unit 105*c* has been unlocked. The process proceeds to Step S28 when it is determined that the shift lock unit 105*c* has not been unlocked yet. By contrast, the process proceeds to Step S31 when it is determined that the shift lock unit 105*c* has been unlocked, i.e., when the unlock signal is inputted into the idling stop controlling unit 485*a* from the shift unlock unit 105*d*.

In Step S28, the control unit 107 determines whether or not the first operating member 105*a* is set in the neutral position. The process proceeds to Step S29 when it is determined that the first operating member 105*a* is in the neutral position. By contrast, the process proceeds to Step S31 when it is determined that the first operating member 105*a* is in a position other than the neutral position.

In Step S29, the control unit 107 determines whether or not the steering angle of the steering member 103*a* is less than or equal to a predetermined angle. The process proceeds to Step S30 when it is determined that the steering angle is less than or equal to the predetermined angle. By contrast, the process proceeds to Step S31 when it is determined that the steering angle is greater than the predetermined angle.

In Step S30, the control unit 107 determines whether or not the dog clutch 20*d* is set in either the first engaged position or the second engaged position. The process returns to Step S25 when it is determined that the dog clutch 20*d* is in the disengaged position. Then in Step S25, the idling stop is continuously performed. By contrast, the process proceeds to Step S31 when it is determined that the dog clutch 20*d* is in either the first engaged position or the second engaged position.

In Step S31, the control unit 107 deactivates the idling stop and restarts the engine 120.

As described above, the engine controlling unit 486*a* is programmed and configured to temporarily stop the engine 120 when the first operating member 105*a* is set in the neutral position and the vessel body 101 is in the stationary state. Thus, the engine controlling unit 486*a* sets the position of the first operating member 105*a* and the navigational state of the vessel body 101 as conditions to activate the idling stop. Therefore, the intention to operate the vessel is reflected in the process of activating the idling stop in the watercraft 100 that is not equipped with a brake pedal or the like.

The engine controlling unit 486*a* is programmed and configured to temporarily stop the engine 120 when the dog clutch 20*d* is in the disengaged position. Thus, the fact that the dog clutch 20*d* is in the disengaged position is set as a condition to activate the idling stop. Therefore, the intention to operate the vessel is more reliably reflected in the process of activating the idling stop. Such an effect is also achieved by the dog clutch 20*d* being set in the engaged position as a condition to deactivate the idling stop.

The engine controlling unit 486*a* is programmed and configured to restart the engine 120 when the shift lock unit 105*c* has been unlocked. Thus, the engine controlling unit 486*a* determines that a vessel operator has attempted to operate the first operating member 105*a* as a condition to deactivate the idling stop. Therefore, the idling stop is more quickly deactivated in comparison with determining that the first operating member 105*a* has been moved from the neutral position and that the dog clutch 20*d* has been moved to the engaged position as conditions to deactivate the idling stop.

The engine controlling unit 486*a* is programmed and configured to restart the engine 120 when the first operating member 105*a* has been moved from the neutral position. Thus, the engine controlling unit 486*a* determines that the first operating member 105*a* has been actually operated by a vessel operator as a condition to deactivate the idling stop. Therefore, the intention to operate the vessel is accurately reflected in the process of deactivating the idling stop.

The second preferred embodiment of the present invention has been explained above. However, the present invention is not limited to the above described second preferred embodiment, and a variety of changes can be made without departing from the scope of the present invention.

In the above described second preferred embodiment, the vessel body state determining unit 481*a* is preferably programmed and configured to determine that the vessel body 101 is in the stationary state when the rotation speed of the propeller shaft 140*b* is less than or equal to a predetermined rotation speed. However, alternatively or additionally to the above, the vessel speed being less than or equal to a predetermined speed may be a condition to deactivate the idling stop. The vessel speed of the watercraft 100 is easily and conveniently obtained using an electromagnetic log or a GNSS receiver.

In the above described second preferred embodiment, both of the shift lock unit 105*c* having been unlocked and the first operating member 105*a* being in the neutral position are preferably conditions to deactivate the idling stop. However, only either of them may be a condition to deactivate the idling stop.

Although not particularly explained in the above described second preferred embodiment, when the conditions to activate the idling stop are satisfied in all of the S, P, and C motors 102*a* to 102*c*, idling stop is preferably activated simultaneously in all of the outboard motors. Alternatively, when the conditions to activate the idling stop are satisfied in one of the S, P, and C motors 102*a* to 102*c*, idling stop may be activated in the outboard motor in which the conditions to activate the idling stop are satisfied.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a vessel body;

a propulsion mechanism configured to switch among a forward thrust state to forwardly move the vessel body, a rearward thrust state to rearwardly move the vessel body, and a neutral state to maintain the vessel body in a stationary state;

an engine configured to drive the propulsion mechanism;

a shift operating unit configured to move to a forward thrust position to switch the propulsion mechanism into the forward thrust state, a rearward thrust position to switch the propulsion mechanism into the rearward thrust state, and a neutral position to switch the propulsion mechanism into the neutral state;

a vessel body state determining unit programmed and configured to determine whether or not the vessel body is in the stationary state; and an engine controlling unit programmed and configured to stop the engine when the shift operating unit is located in the neutral position and the vessel body state determining unit determines that the vessel body is in the stationary state; wherein the propulsion mechanism includes a jet propulsion device and a bucket, the jet propulsion device is configured to rearwardly eject a jet of water, and the bucket is disposed rearward of the jet propulsion device;

the bucket is configured to move to a first bucket position to cause the jet of water to flow rearward, a second bucket position to cause the jet of water to flow forward, and a third bucket position located differently from the first bucket position and the second bucket position; and the engine controlling unit is programmed and configured to stop the engine when the bucket is located in the third bucket position.

2. The watercraft according to claim 1, further comprising:

a timer unit configured to count a cumulative time that the shift operating unit is maintained in the neutral position; wherein the engine controlling unit is programmed and configured to stop the engine when the cumulative time has exceeded a predetermined period of time.

3. The watercraft according to claim 1, further comprising:

a steering unit configured to regulate a moving direction of the vessel body; and a hold detecting unit programmed and configured to detect that the steering unit is being held by a vessel operator; wherein after stopping the engine, the engine controlling unit is programmed and configured to restart the engine when the hold detecting unit detects that the steering unit is being held by the vessel operator.

4. The watercraft according to claim 1, further comprising:

a throttle operating unit configured to regulate a rotation speed of the engine; and a throttle operation detecting unit programmed and configured to detect that the throttle operating unit has been operated; wherein after stopping the engine, the engine controlling unit is programmed and configured to restart the engine when the throttle operation detecting unit detects that the throttle operating unit has been operated.

5. The watercraft according to claim 4, further comprising:

a steering unit configured to regulate a moving direction of the vessel body, wherein the throttle operating unit is a lever attached to the steering unit.

6. The watercraft according to claim 1, further comprising:

a shift operation detecting unit configured to detect that the shift operating unit is located in either a first shift detection region located between the forward thrust position and the neutral position or a second shift detection region located between the rearward thrust position and the neutral position; wherein after stopping the engine, the engine controlling unit is programmed and configured to restart the engine when the shift operation detecting unit detects that the shift operating unit is located in either the first shift detection region or the second shift detection region.

7. The watercraft according to claim 1, wherein the vessel body state determining unit is programmed and configured to determine that the vessel body is in the stationary state when a speed of the vessel body is less than or equal to a predetermined speed.

8. The watercraft according to claim 1, wherein the vessel body state determining unit is programmed and configured to determine that the vessel body is in the stationary state when a rotation speed of the engine is less than or equal to a predetermined rotation speed.

9. The watercraft according to claim 1, further comprising:

a drive shaft coupled to the engine;

a propeller shaft; and a shift mechanism configured to switch an engaged/disengaged state between the drive shaft and the propeller shaft; wherein the vessel body state determining unit is programmed and configured to determine that the vessel body is in the stationary state when a rotation speed of the propeller shaft is less than or equal to a predetermined rotation speed.

10. A watercraft comprising:

a vessel body;

a propulsion mechanism configured to switch among a forward thrust state to forwardly move the vessel body, a rearward thrust state to rearwardly move the vessel body, and a neutral state to maintain the vessel body in a stationary state;

an engine configured to drive the propulsion mechanism;

a shift operating unit configured to move to a forward thrust position to switch the propulsion mechanism into the forward thrust state, a rearward thrust position to switch the propulsion mechanism into the rearward thrust state, and a neutral position to switch the propulsion mechanism into the neutral state;

a vessel body state determining unit programmed and configured to determine whether or not the vessel body is in the stationary state;

an engine controlling unit programmed and configured to stop the engine when the shift operating unit is located in the neutral position and the vessel body state determining unit determines that the vessel body is in the stationary state; a drive shaft coupled to the engine;

a propeller shaft;

a shift mechanism configured to switch an engaged/disengaged state between the drive shaft and the propeller shaft; and a propeller shaft state determining unit programmed and configured to determine whether or not the propeller shaft is in a non-rotated state; wherein the engine controlling unit is programmed and configured to stop the engine when the propeller shaft state determining unit determines that the propeller shaft is in the non-rotated state.

11. A watercraft comprising:

a vessel body;

a propulsion mechanism configured to switch among a forward thrust state to forwardly move the vessel body, a rearward thrust state to rearwardly move the vessel body, and a neutral state to maintain the vessel body in a stationary state;

an engine configured to drive the propulsion mechanism;

a shift operating unit configured to move to a forward thrust position to switch the propulsion mechanism into the forward thrust state, a rearward thrust position to switch the propulsion mechanism into the rearward thrust state, and a neutral position to switch the propulsion mechanism into the neutral state;

a vessel body state determining unit programmed and configured to determine whether or not the vessel body is in the stationary state;

an engine controlling unit programmed and configured to stop the engine when the shift operating unit is located in the neutral position and the vessel body state determining unit determines that the vessel body is in the stationary state;

a shift lock unit configured to restrict the shift operating unit from moving from the neutral position to the forward thrust position and the rearward thrust position; and a shift unlock unit attached to the shift operating unit, the shift unlock unit configured to cancel a restriction from by the shift lock unit; wherein after stopping the engine, the engine controlling unit is programmed and configured to restart the engine when the shift unlock unit has been operated.

12. A watercraft comprising:

a vessel body;

a propulsion mechanism configured to switch among a forward thrust state to forwardly move the vessel body, a rearward thrust state to rearwardly move the vessel body, and a neutral state to maintain the vessel body in a stationary state;

an engine configured to drive the propulsion mechanism;

a drive shaft coupled to the engine;

a propeller shaft;

a shift mechanism including a dog clutch attached to the propeller shaft, the shift mechanism being configured to switch an engaged/disengaged state between the drive shaft and the propeller shaft;

a shift operating unit configured to move to a forward thrust position to switch the propulsion mechanism into the forward thrust state, a rearward thrust position to switch the propulsion mechanism into the rearward thrust state, and a neutral position to switch the propulsion mechanism into the neutral state;

a vessel body state determining unit programmed and configured to determine whether or not the vessel body is in the stationary state; and an engine controlling unit programmed and configured to stop the engine when the shift operating unit is located in the neutral position and the vessel body state determining unit determines that the vessel body is in the stationary state; wherein the dog clutch is configured to be moved to a first engaged position to cause the propeller shaft to be engaged with the drive shaft so as to rotate the propeller shaft in a direction to forwardly move the vessel body, a second engaged position to cause the propeller shaft to be engaged with the drive shaft so as to rotate the propeller shaft in a direction to rearwardly move the vessel body, and a disengaged position to separate the propeller shaft from the drive shaft; and the engine controlling unit is programmed and configured to stop the engine when the dog clutch is located in the disengaged position.

13. The watercraft according to claim 12, wherein, after stopping the engine, the engine controlling unit is programmed and configured to restart the engine when the dog clutch is located in either the first engaged position or the second engaged position.

* * * * *